US010245863B2

(12) United States Patent
Nagase et al.

(10) Patent No.: US 10,245,863 B2
(45) Date of Patent: Apr. 2, 2019

(54) RECORDING APPARATUS

(71) Applicant: SEIKO EPSON CORPORATION, Tokyo (JP)

(72) Inventors: Masachika Nagase, Fujimi-machi (JP); Hisayuki Akahane, Matsumoto (JP); Toshio Miyake, Shiojiri (JP); Eiji Taketsugu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 11 days.

(21) Appl. No.: 15/709,146

(22) Filed: Sep. 19, 2017

(65) Prior Publication Data

US 2018/0093510 A1 Apr. 5, 2018

(30) Foreign Application Priority Data

Sep. 30, 2016 (JP) ..... 2016-192986

(51) Int. Cl.

| | |
|---|---|
| ***B41J 3/36*** | (2006.01) |
| ***B41J 29/02*** | (2006.01) |
| ***B41J 29/38*** | (2006.01) |
| ***B41J 2/01*** | (2006.01) |
| ***B41J 23/00*** | (2006.01) |
| ***B41J 29/13*** | (2006.01) |

(52) U.S. Cl.

CPC ..... *B41J 23/00* (2013.01); *B41J 2/01* (2013.01); *B41J 3/36* (2013.01); *B41J 29/02* (2013.01); *B41J 29/13* (2013.01); *B41J 29/38* (2013.01)

(58) Field of Classification Search

CPC ..... B41J 3/36; B41J 29/02; B41J 2/01; B41J 29/38

See application file for complete search history.

(56) References Cited

U.S. PATENT DOCUMENTS

2001/0040617 A1* 11/2001 Yoshino ..... B41J 29/393 347/108
2003/0197881 A1* 10/2003 Inoue ..... B41J 11/0055 358/1.12
2004/0067089 A1* 4/2004 Tanaami ..... B41J 29/02 400/693
2015/0294195 A1 10/2015 Shirota et al.
2015/0375949 A1 12/2015 Kanemaru et al.

FOREIGN PATENT DOCUMENTS

JP 2015-202615 A 11/2015
JP 2016-008124 A 1/2016

* cited by examiner

*Primary Examiner* — Kristal Feggins
*Assistant Examiner* — Kendrick X Liu
(74) *Attorney, Agent, or Firm* — Workman Nydegger

(57) ABSTRACT

Of at least three drive sources provided inside a printer body, a carriage-driving motor and a transport motor are disposed on one side with respect to a center portion in a width direction that intersects a medium transport direction while a sheet-feed motor is disposed on the other side with respect to the center portion in the width direction. The battery that provides electric power to the three drive sources is disposed such that the center of gravity of the battery is on the other side with respect to the center portion in the width direction.

10 Claims, 14 Drawing Sheets

RECORDING APPARATUS

BACKGROUND

1. Technical Field

The present invention relates to a recording apparatus that performs recording onto media.

2. Related Art

A recording apparatus, of which a printer is a representative example, includes various rollers, such as an advancing roller for sending a medium that is set in a media-setting unit, a transport roller for transporting the medium sent by the advancing roller to a recording region in which a recording device operates, and a discharge roller for discharging the medium recorded by the recording device from a discharge unit. These rollers are driven by drive sources, such as motors. For example, JP-A-2016-008124 discloses a recording apparatus that includes two motors, specifically, a first motor 40 for driving a feed roller 35 that serves as the advancing roller and a second motor 60 for driving a transport roller pair 53 that serves as the transport roller and for driving a discharge roller pair 54 that serves as the discharge roller.

A serial-type printer is an example of the printer. In a serial-type printer, the recording device is mounted in a carriage that moves in a medium width direction that intersects a medium transport direction. A serial-type printer completes printing by alternately performing a medium transport operation, in which the transport roller transports a medium, and a recording operation that is performed while the carriage moves in the media width direction. In addition to the two motors for driving the advancing roller, the transport roller, and the discharge roller, this type of printer may include a total of three motors, further including a motor (a drive source) for moving the carriage.

An example of this type of printer is a mobile-type printer that is small, lightweight, and easy to carry (for example, see JP-A-2015-202615).

A mobile-type printer may have a rechargeable internal battery to enable outdoor use where no external power source is available. Users expect, in accordance with their requirements, further downsizing of such mobile-type printers. For a portable mobile-type printer, stability is also required when carrying or placing the printer. Thus, the weight distribution of the whole apparatus is important.

However, limited space inside the apparatus is available for arranging the internal battery and a plurality of motors (for example, three motors, i.e., a motor for the advancing roller, a motor for the transport and discharge rollers, and a motor for the carriage) that are relatively heavy and large. In addition, limited options are available for the arrangement of other components.

SUMMARY

An advantage of some aspects of the invention is that a recording apparatus that can be stably carried and placed is provided.

A recording apparatus according to a first aspect of the invention includes an apparatus body including therein a recording device that performs recording onto a medium to be transported; at least three drive sources provided inside the apparatus body; a battery provided inside the apparatus body and supplying electric power to the three drive sources; and a battery accommodation portion provided inside the apparatus body and accommodating the battery. Of the three drive sources, a first drive source and a second drive source are disposed on one side of the apparatus body with respect to a center portion of the apparatus body in a width direction that intersects a medium transport direction, and a third drive source is disposed on the other side of the apparatus body with respect to the center portion in the width direction, and the battery has a center of gravity that is on the other side with respect to the center portion in the width direction.

Drive sources such as motors are heavy items. When two of the three drive sources (i.e., the first drive source and the second drive source) are disposed on one side with respect to the center portion in the width direction that intersects the medium transport direction while the other drive source (i.e., the third drive source) is disposed on the other side with respect to the center portion, the weight distribution of the whole apparatus in the width direction tends to be shifted toward the one side on which two drive sources are provided. In accordance with the first aspect, the battery is disposed such that the center of gravity of the battery is on the other side with respect to the center portion in the width direction. This can balance the weight distribution of the whole apparatus in the width direction. As a result, the recording apparatus can be stably carried and placed.

It is preferable that the recording apparatus according to the first aspect further include a carriage that holds the recording device and moving in a direction intersecting the medium transport direction, in which any of the first drive source and the second drive source is a drive source for the carriage.

In this case, the effect similar to that obtained in the first aspect can also be provided by the recording apparatus that includes a carriage that holds the recording device and moving in a direction intersecting the medium transport direction and in which any of the first drive source and the second drive source is a drive source for the carriage.

A recording apparatus according to a second aspect of the invention includes an apparatus body including therein a recording device that performs recording onto a medium to be transported; a feed device provided inside the apparatus body and feeding the medium toward the recording device from a position at which the medium is set; a battery provided inside the apparatus body; and a battery accommodation portion provided inside the apparatus body and accommodating the battery. In addition, at least a portion of the battery accommodation portion is located below the feed device.

In accordance with the second aspect, at least a portion of the battery accommodation portion is located below the feed device and the battery accommodation portion accommodates the battery that is a heavy item. This lowers the center of gravity of the whole recording apparatus and thereby enables the recording apparatus to be stably carried and placed.

It is preferable that the recording apparatus according to the first aspect further include a locking mechanism disposed inside the apparatus body. In the recording apparatus, the battery includes a second contact point that is electrically coupled to a first contact point provided inside the apparatus body and that is formed such that the battery can be inserted into and removed from the battery accommodation portion. The locking mechanism fastens the battery to the apparatus body with the first contact point and the second contact point being connected to each other. In addition, the locking mechanism includes a lock pin that assumes an advancing state in which the lock pin advances in a direction intersecting an insertion direction of the battery or a retracting state in which the lock pin is further away from the battery than in the advancing state, and the locking mechanism also includes an urging device that urges the lock pin toward the advancing state. The locking mechanism is formed such that the lock pin enters a locking state by engaging with an engagement portion provided in the battery when the lock pin is in the advancing state and enters an unlocking state when the lock pin is in the retracting state, and an urging force of the urging device is such that the battery is not dislodged due to weight when the apparatus body is inclined such that a direction in which the battery may be dislodged is aligned with a gravity direction.

In this case, when the apparatus body is inclined such that a direction in which the battery may be dislodged is aligned with a gravity direction, the likelihood of the battery coming out can be reduced.

It is preferable that in this recording apparatus, the lock pin include an inclined surface that is provided at a tip of the lock pin opposing the engagement portion and that faces at least downstream of the tip in the insertion direction of the battery.

In this case, the locking mechanism reliably enters the locking state. This issue will be described below in detail.

It is preferable that this recording apparatus further include a cover member that opens and closes the battery accommodation portion.

In this case, the likelihood of foreign matter entering the apparatus body through the battery insertion/removal opening can be reduced or eliminated.

It is also preferable that in this recording apparatus, a contact length of the first contact point in the insertion direction of the battery be larger than a distance between the cover member in a closed state and a trailing end of the battery in the insertion direction of the battery when the locking mechanism is in the locking state.

In this case, in the state in which the cover member is closed, the connection between the first contact point and the second contact point can be maintained more reliably.

It is preferable that the recording apparatus according to the first aspect further include a battery insertion/removal opening at the battery accommodation portion, in which the battery is formed to have an asymmetrical cross-sectional shape along a cross section taken in a direction intersecting the insertion direction, and the battery insertion/removal opening is shaped so as to fit the asymmetrical cross-sectional shape.

In this case, the battery is formed to have an asymmetrical cross-sectional shape along a cross section taken in a direction intersecting the insertion direction, and the battery insertion/removal opening at the battery accommodation portion is shaped so as to fit the asymmetrical cross-sectional shape. Thus, a user can easily recognize the insertion direction of the battery. The user can also avoid inserting the battery in a wrong direction.

It is preferable that in the recording apparatus according to the first aspect, the battery accommodation portion include a support rib for supporting the battery and a restraining rib for restraining the battery from moving upward.

In this case, the battery accommodation unit includes a support rib for supporting the battery and a restraining rib for restraining the battery from moving upward. Thus, the battery can be smoothly inserted into and removed from the battery accommodation portion.

It is preferable that the recording apparatus according to the first aspect further include a waste liquid box that is provided in a bottom portion of the apparatus body and that is for receiving waste liquid from the recording device. In addition, at least a portion of the waste liquid box and at least a portion of the battery accommodation portion overlap each other in a height direction of the apparatus body.

In this case, at least a portion of the battery accommodation portion and at least a portion of the waste liquid box overlap in the height direction of the apparatus. This can reduce the height of the recording apparatus.

It is preferable that in this recording apparatus, the bottom portion of the apparatus body be occupied by the battery accommodation portion and the waste liquid box.

Note that "occupied" in the context above means "mostly occupied" and does not necessarily mean "totally (100%) occupied". In other words, most part of the bottom portion of the apparatus body is occupied by the battery accommodation portion and the waste liquid box. In this case, most part of the bottom portion of the apparatus body is occupied by the battery accommodation portion in which the relatively heavy battery is accommodated and also by the waste liquid box that becomes heavier as waste liquid accumulates. This contributes to a further increase in the stability of the recording apparatus when it is placed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Example 1

Figure 1:
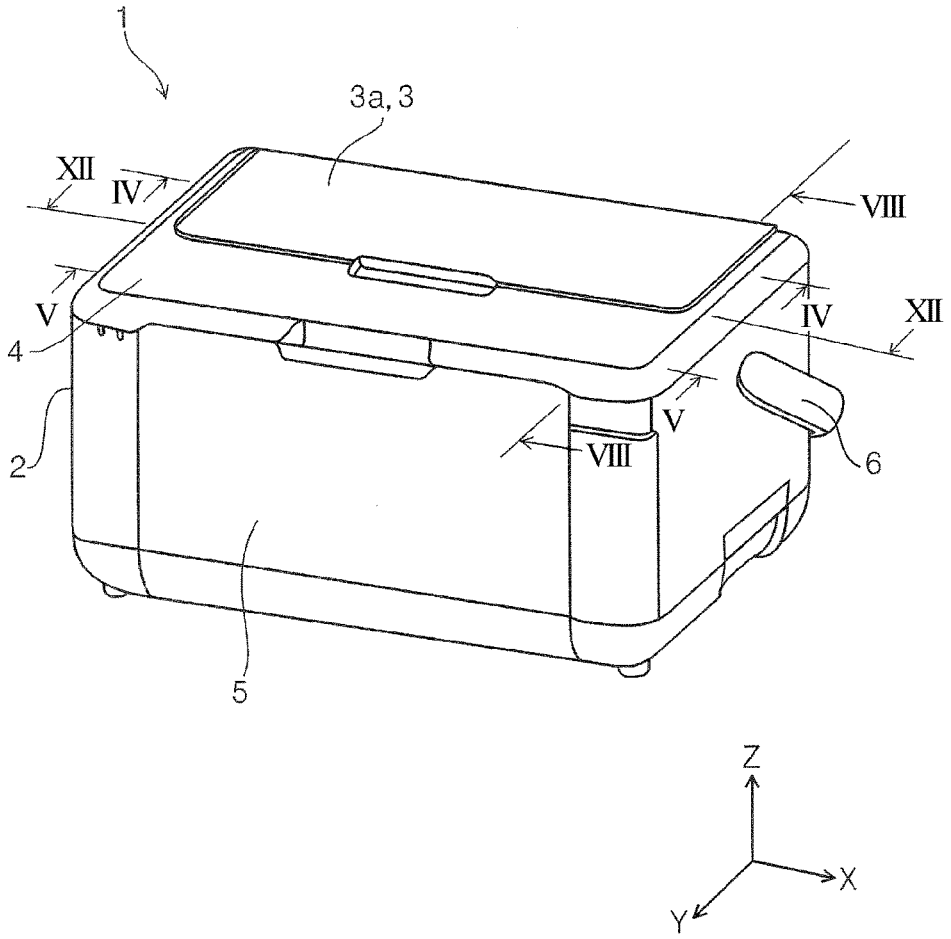
FIG. 1 is a perspective view illustrating the exterior of an example of a printer according to the invention.
Figure 2:
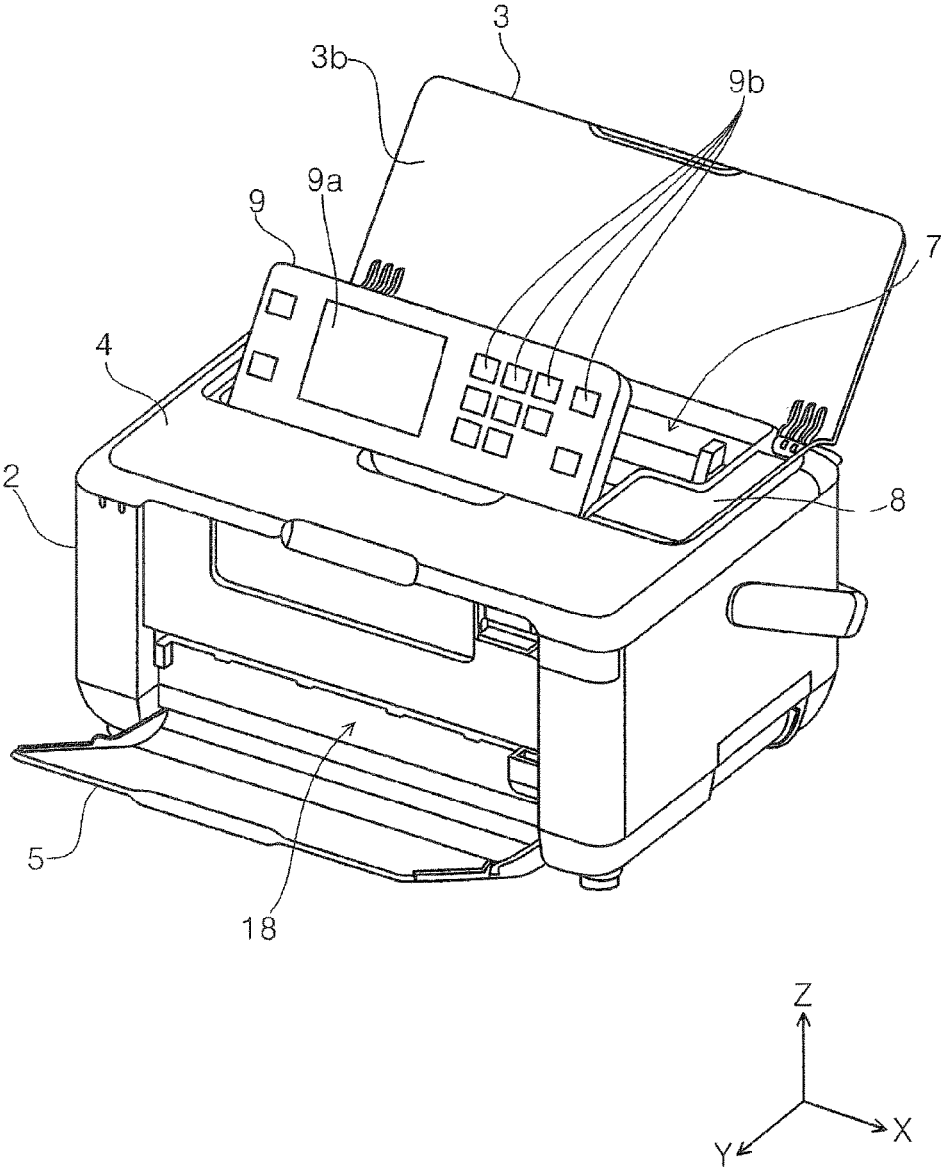
FIG. 2 is a perspective view illustrating a state in which a first top side cover and a sheet-discharge cover are open in the printer according to the invention.
Figure 3:
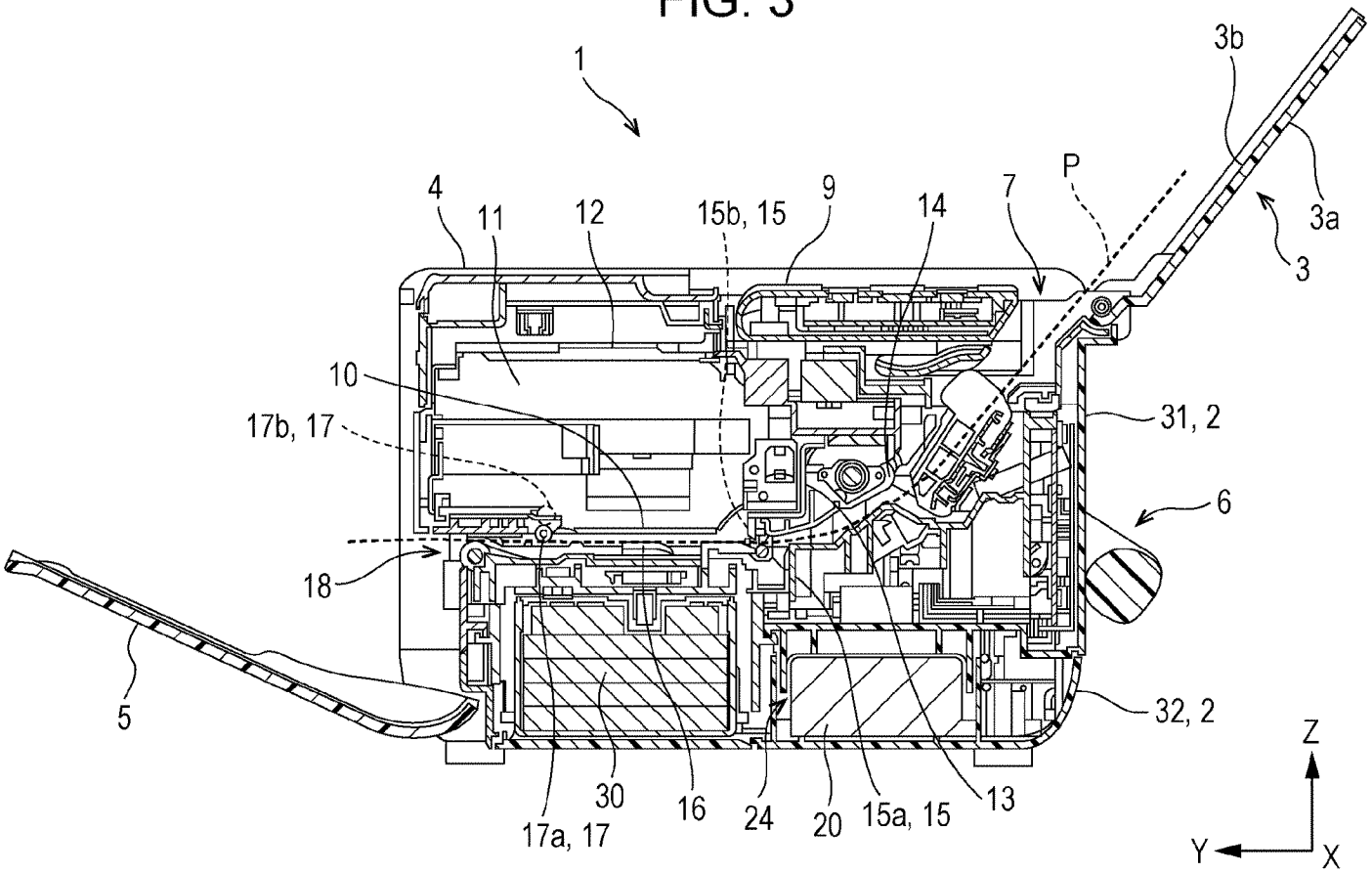
FIG. 3 is a cross-sectional side view illustrating a sheet transport path of the printer according to the invention.
Figure 4:
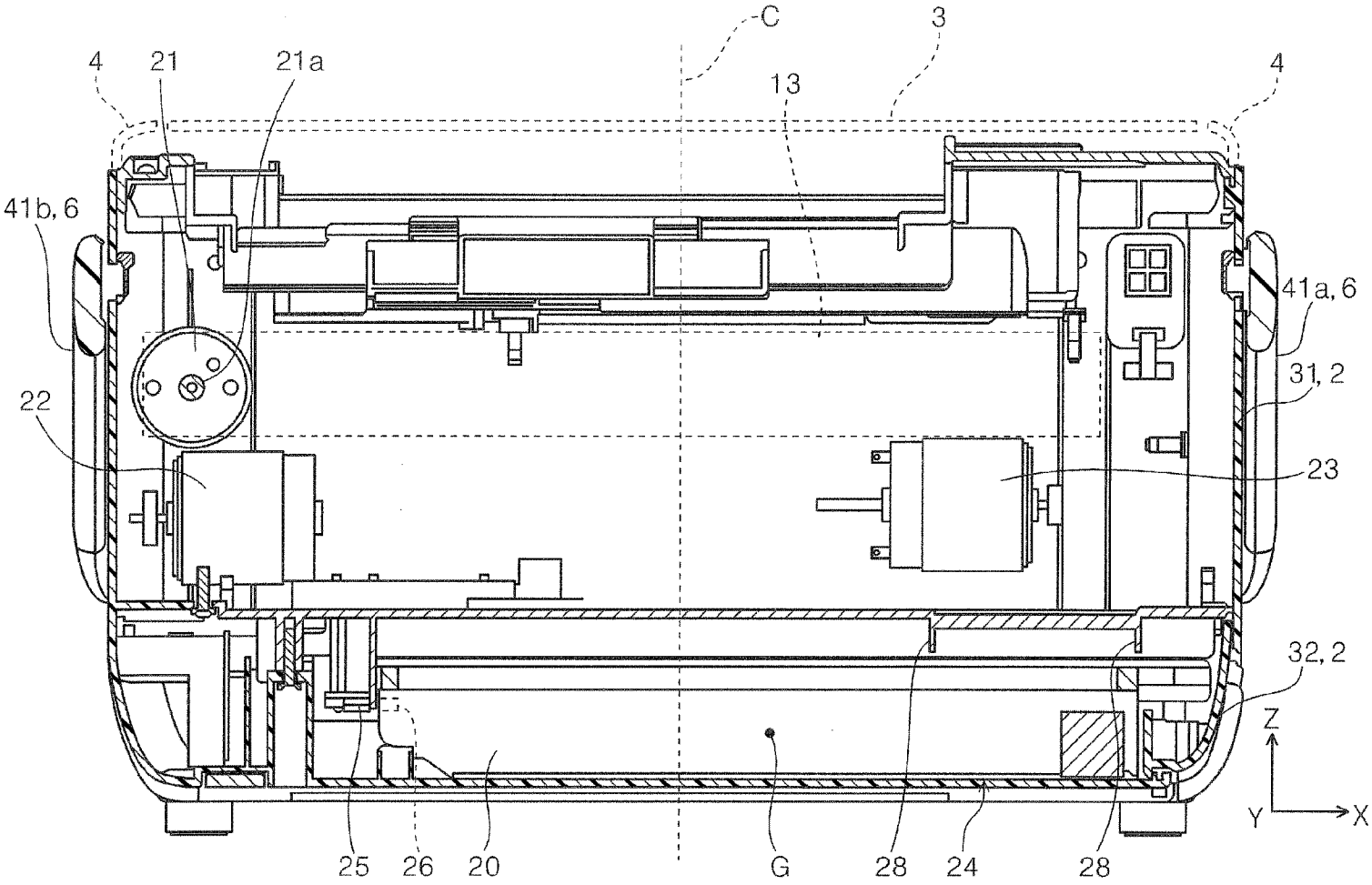
FIG. 4 is a view taken along line IV-IV in FIG. 1 and viewed in the direction of arrow IV and illustrates positional relationships of a battery and three drive sources.
Figure 5:
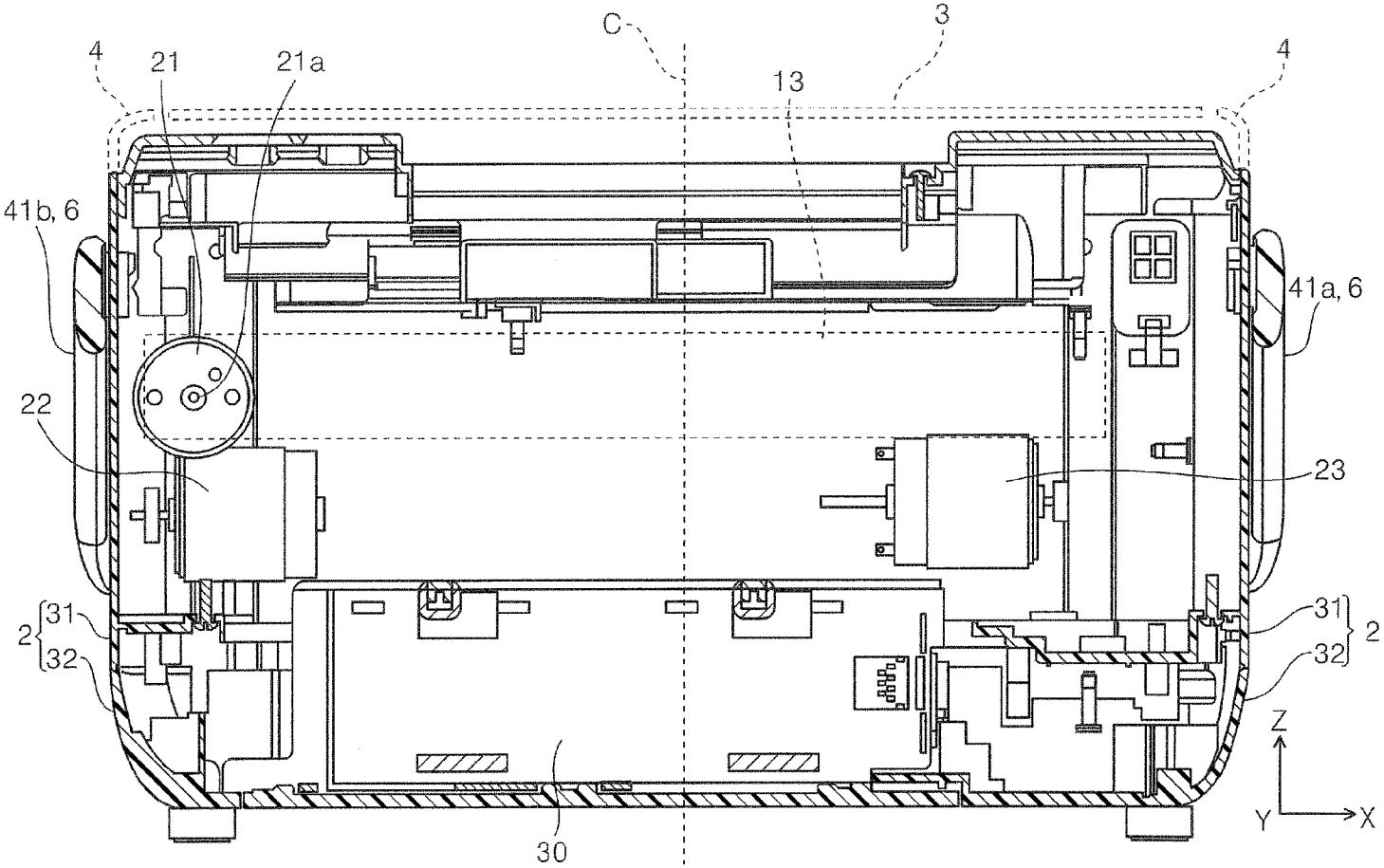
FIG. 5 is a view taken along line V-V in FIG. 1 and viewed in the direction of arrow V and illustrates positional relationships of a waste liquid box and the three drive sources.
Figure 6:
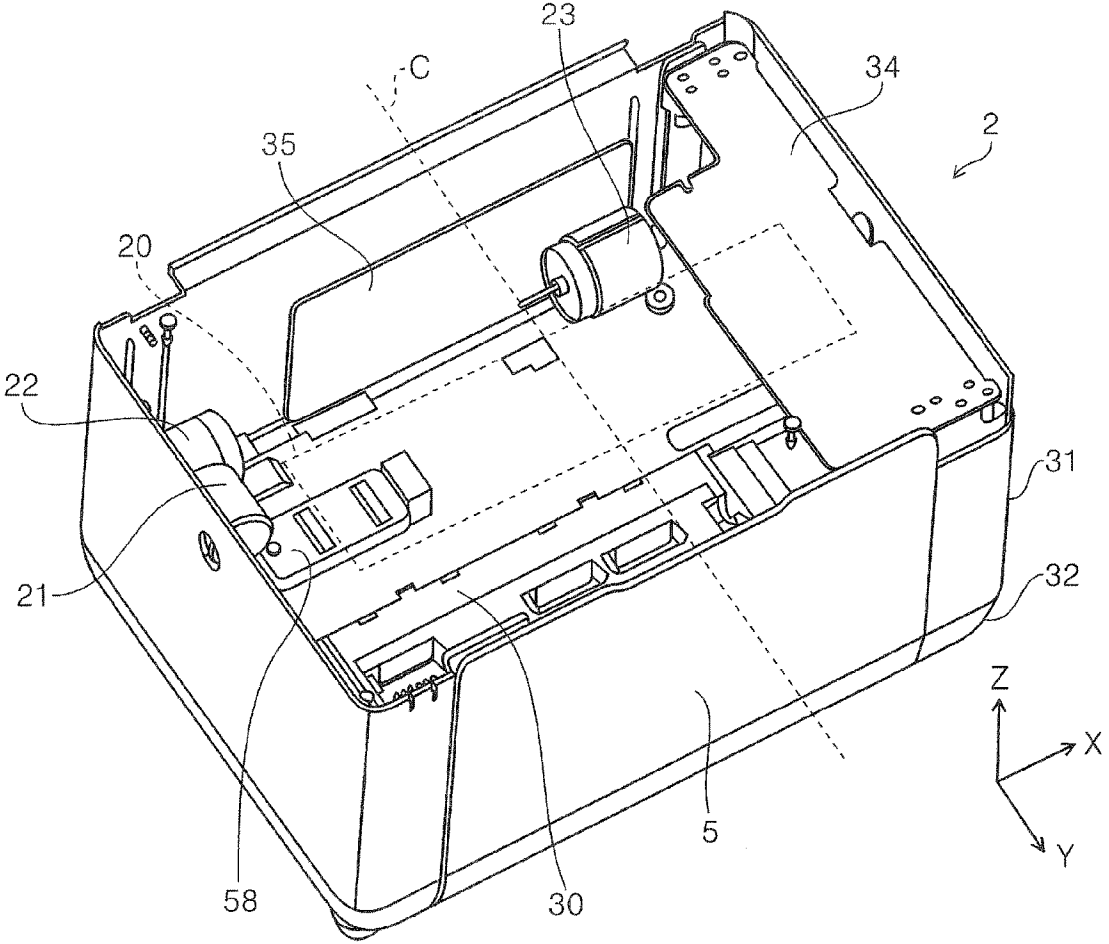
FIG. 6 is a view illustrating positional relationships of the battery, the waste liquid box, and the three drive sources inside an apparatus body.

A recording apparatus according to one example of the invention will be described first. In the present example, an ink jet type printer 1 (hereinafter referred to simply as "printer 1") will be described as an example of the recording apparatus. FIG. 1 is a perspective view illustrating the exterior of an example of a printer according to the invention. FIG. 2 is a perspective view illustrating a state in which a first top side cover and a sheet-discharge cover of the printer according to the invention are open. FIG. 3 is a cross-sectional side view illustrating a sheet transport path of the printer according to the invention. FIG. 4 is a view taken along line IV-IV in FIG. 1 and viewed in the direction of arrow IV and illustrates positional relationships of a battery and three drive sources. FIG. 5 is a view taken along line V-V in FIG. 1 and viewed in the direction of arrow V and illustrates positional relationships of a waste liquid box and the three drive sources. FIG. 6 is a view illustrating positional relationships of the battery, the waste liquid box, and the three drive sources inside an apparatus body.

Figure 7:
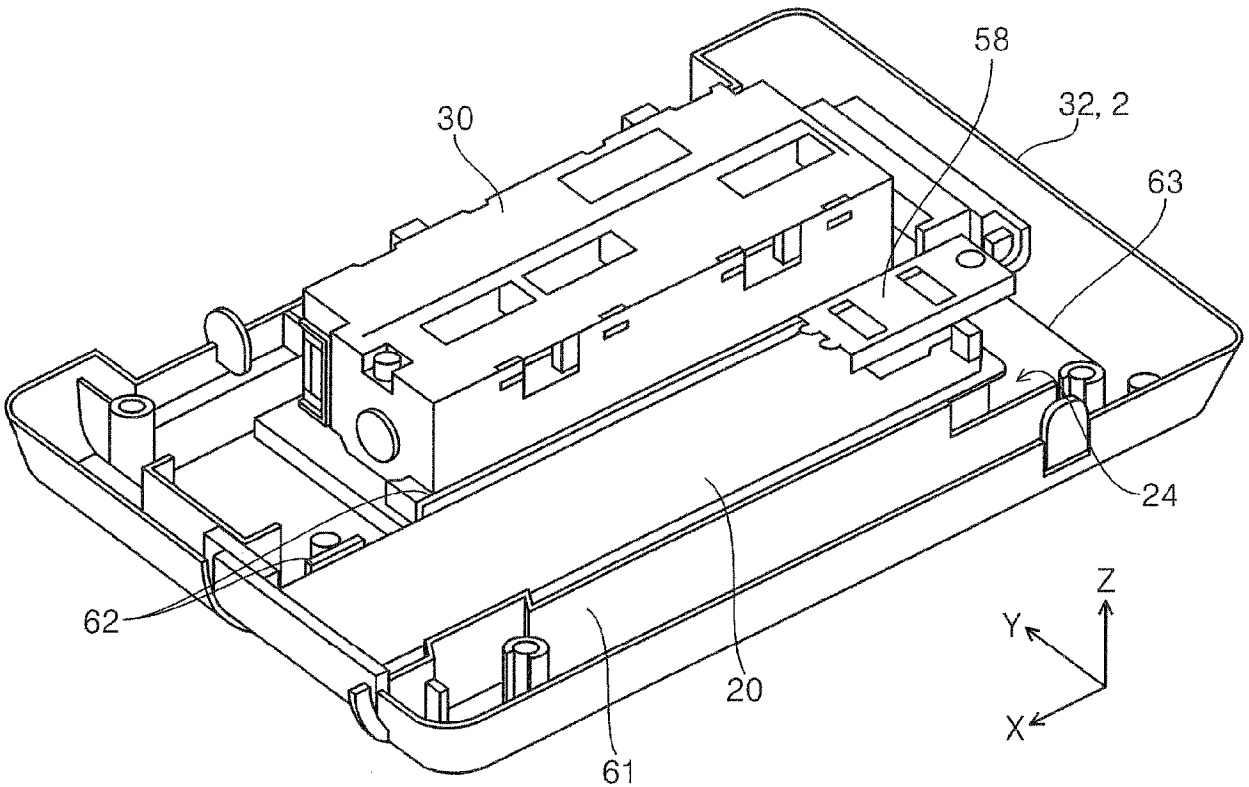
FIG. 7 is a perspective view illustrating a lower housing constituting the apparatus body.
Figure 8:
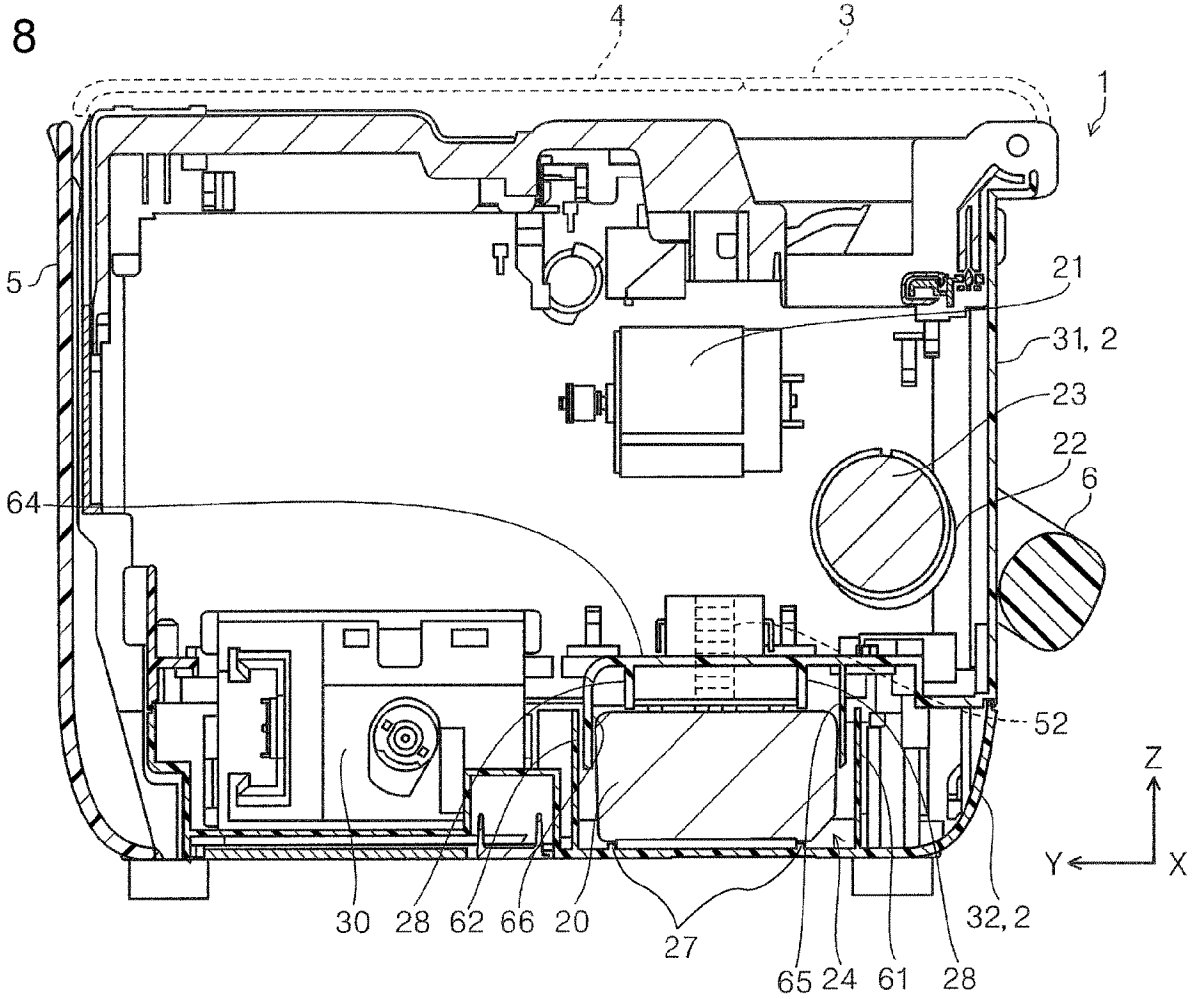
FIG. 8 is a cross-sectional view taken along line VIII-VIII in FIG. 1 and viewed in the direction of arrow VIII.
Figure 9:
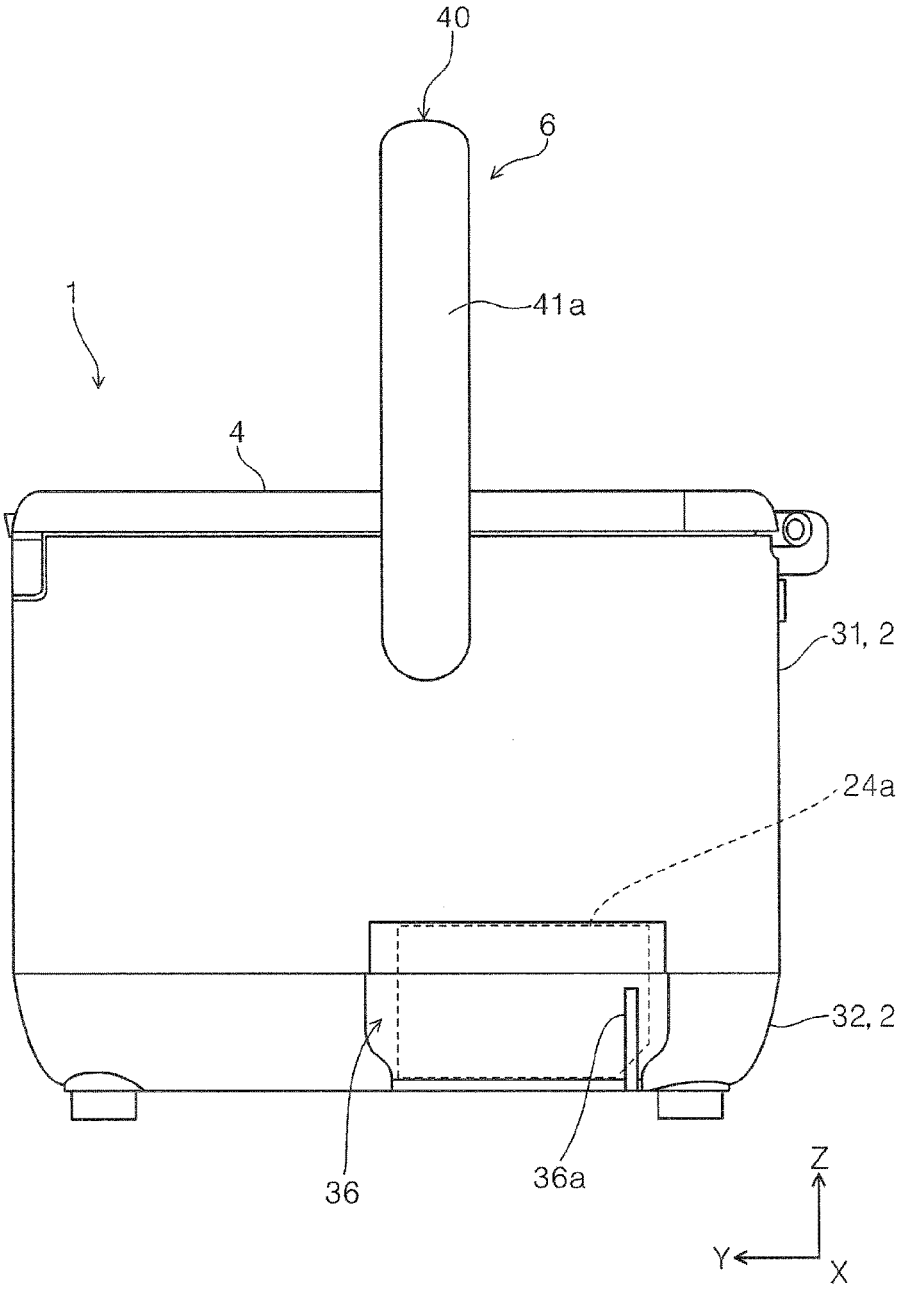
FIG. 9 is a side view illustrating the printer according to the invention.
Figure 10:
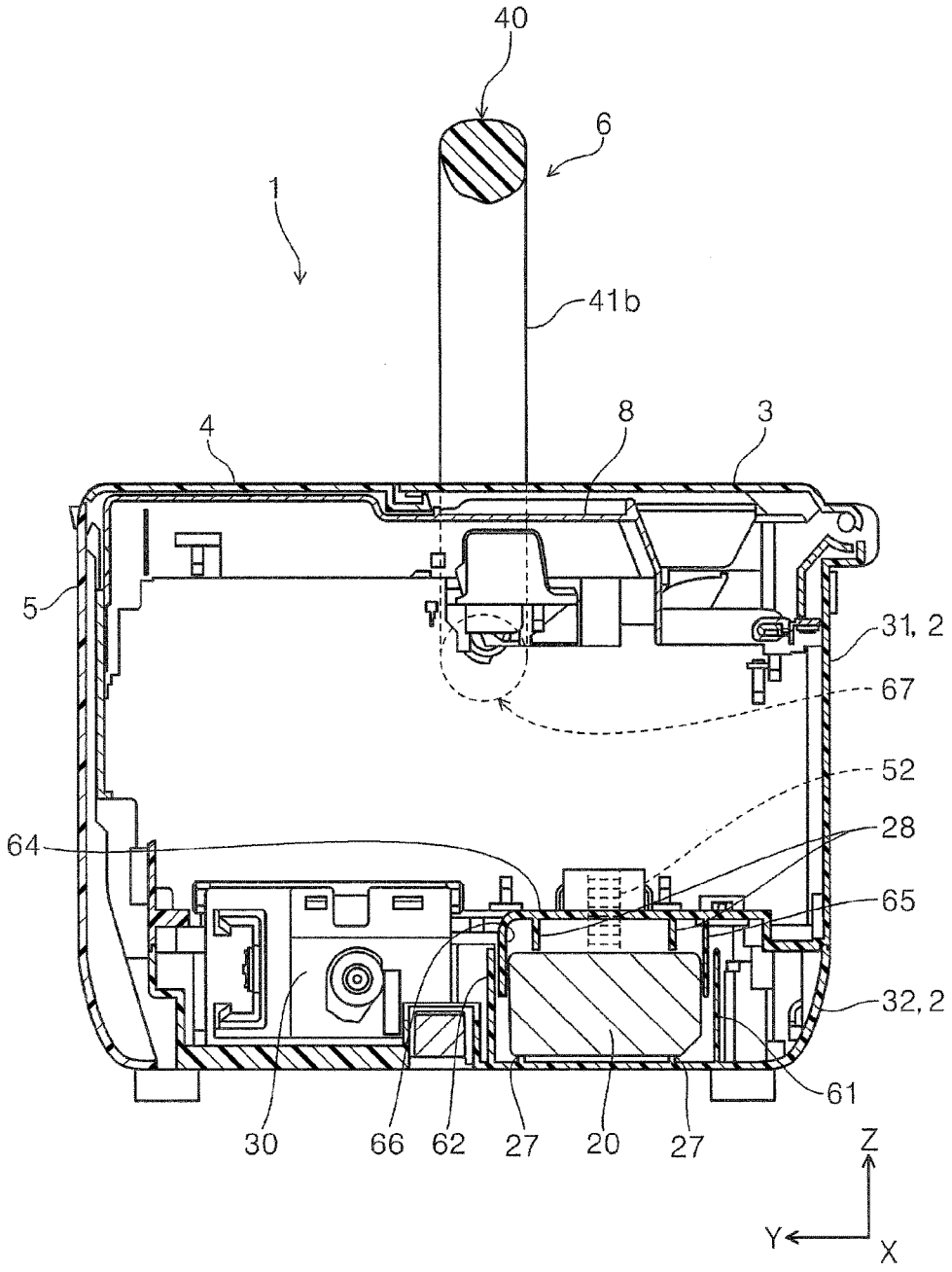
FIG. 10 is a cross-sectional side view illustrating the printer in FIG. 9.
Figure 11:
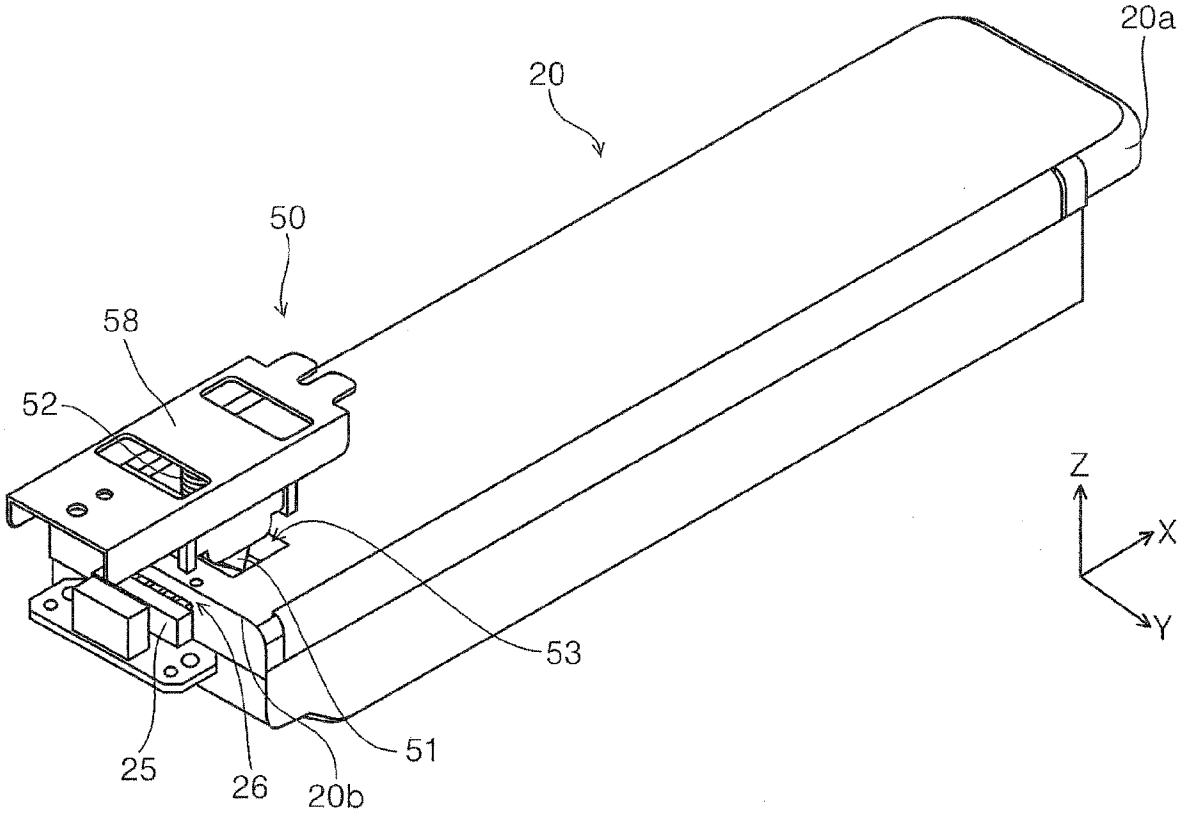
FIG. 11 is a perspective view illustrating the battery and a locking mechanism.
Figure 12:
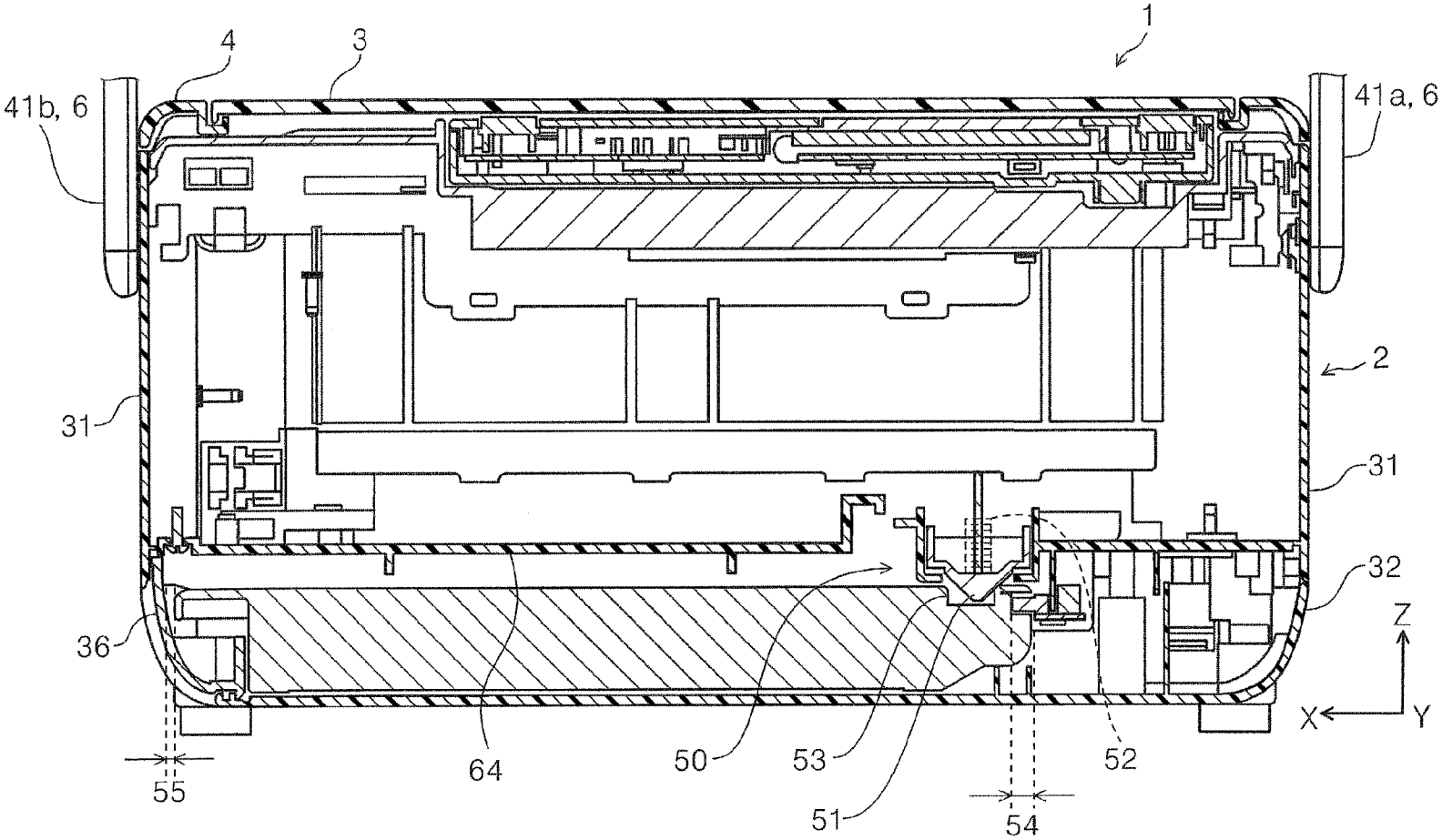
FIG. 12 is a cross-sectional view taken along line XII-XII in FIG. 1 and viewed in the direction of arrow XII.
Figure 13:
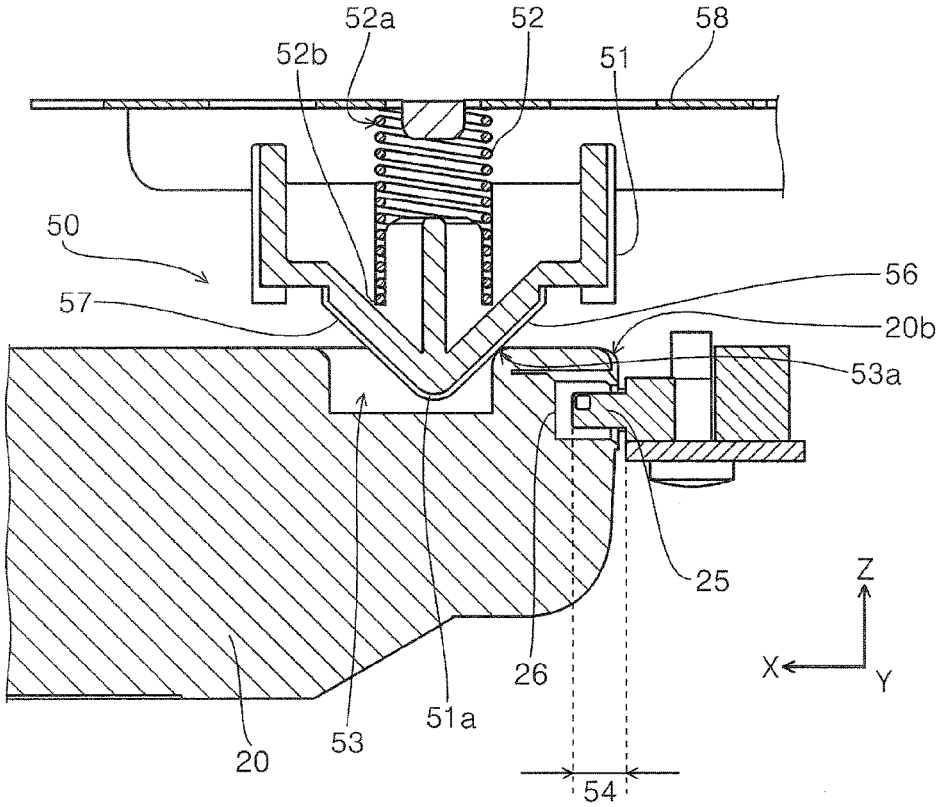
FIG. 13 is a cross-sectional side view illustrating a locking state of the locking mechanism.
Figure 14:
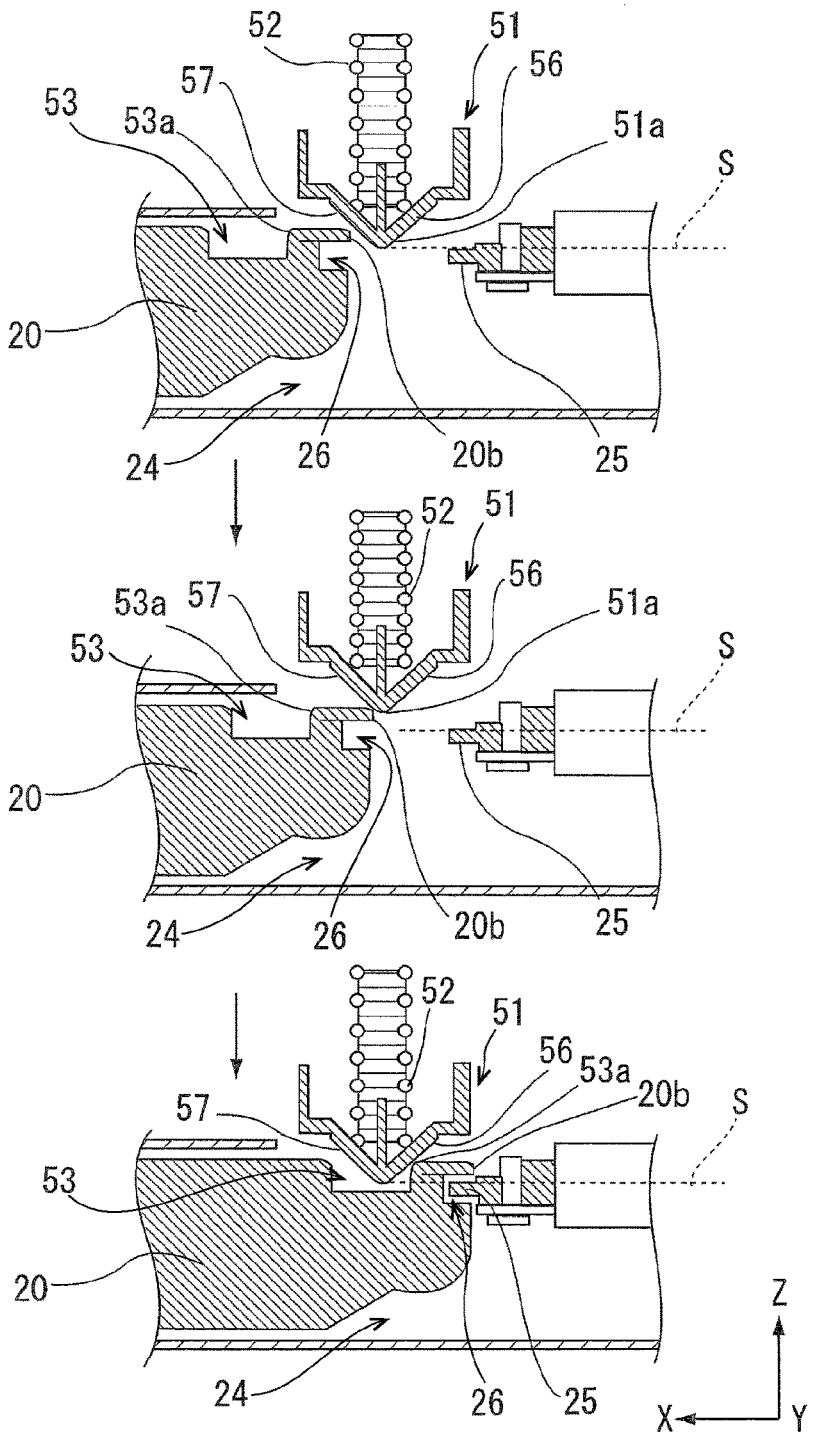
FIG. 14 is a view illustrating operation of the locking mechanism.

FIG. 7 is a perspective view illustrating a lower housing constituting the apparatus body. FIG. 8 is a cross-sectional view taken along line VIII-VIII in FIG. 1 and viewed in the direction of arrow VIII. FIG. 9 is a side view illustrating the printer according to the invention. FIG. 10 is a cross-sectional side view illustrating the printer in FIG. 9. FIG. 11 is a perspective view illustrating the battery and a locking mechanism. FIG. 12 is a cross-sectional view taken along line XII-XII in FIG. 1 and viewed in the direction of arrow XII. FIG. 13 is a cross-sectional side view illustrating a locking state of the locking mechanism. FIG. 14 is a view illustrating operation of the locking mechanism.

Note that in the X-Y-Z coordinate system shown in each of the drawings, the X direction denotes the moving direction of a recording head, in other words, the width direction of the recording apparatus. The Y direction denotes the depth direction of the recording apparatus, and the Z direction denotes the height direction of the recording apparatus. Note that the +Y direction indicates a direction of the front side of the apparatus or an area in front of the apparatus while the −Y direction indicates a direction of the rear side of the apparatus or an area behind the apparatus. In addition, when viewed from the front side of the apparatus, the +X direction indicates a direction of the right side of the apparatus while the −X direction indicates a direction of the left side. The +Z direction indicates a direction of an upper side of the apparatus (including a top portion, the top side, etc., of the apparatus) while the −Z direction indicates a direction of a lower side of the apparatus (including a bottom portion, the bottom side, etc., of the apparatus).

Overall Structure of Printer

The overall structure of the printer 1 will be described with reference to FIGS. 1 to 3. The exterior of the printer 1 (FIG. 1) is formed of an apparatus body 2 having therein a recording head 10 (FIG. 3) that serves as a "recording device" (to be described below), a first top side cover 3 and a second top side cover 4 that open and close a top portion 8 (FIG. 2) of the apparatus body 2, a sheet-discharge cover 5 that opens and closes at the front side of the apparatus body 2 (i.e., the side surface in the +Y direction), and a handle 6 that is rotatably attached to the apparatus body 2. The apparatus body 2, the first top side cover 3, the second top side cover 4, the sheet-discharge cover 5, and the handle 6 can be formed of a resin material, such as a plastic. The type of resin material can be selected separately for each member. Other materials, such as metal materials, may be used for some of the members.

A sheet-setting opening 7 is provided in the top portion 8 of the apparatus body 2 (see FIG. 2). Sheets of paper that serve as "media" are inserted and set into the sheet-setting opening 7. The first top side cover 3 is a cover that opens and closes a region including the sheet-setting opening 7 and a panel unit 9 (to be described below) in the top portion 8 of the apparatus body 2. As illustrated in FIG. 2 and FIG. 3, the first top side cover 3, which includes a support surface **3*b*, is formed such that the support surface 3*b* supports the sheets of paper that are set in the sheet-setting opening 7 when the first top side cover 3 opens and assumes an inclined position. The support surface 3*b* is the backside of the top side cover 3, which is opposite to a top surface 3*a* that is exposed as part of the exterior when the first top side cover 3 is closed. The panel unit 9 (FIG. 2) is an operation unit of the printer 1 that accepts operation input. A liquid crystal display 9*a* that displays various types of information, such as menu items and error messages, and operation buttons 9*b* are arranged on the panel unit 9. The panel unit 9 is formed such that it is tiltable and such that as illustrated in FIG. 2, the liquid crystal display 9*a* may be raised toward the front side of the printer 1 at least in a state in which the first top side cover 3** is open.

The second top side cover 4 is formed so as to be able to open and close regions other than the region that the first top side cover 3 opens and closes in the top portion 8 of the apparatus body 2.

Sheet Transport Path of Printer

Next, a sheet transport path in the printer 1 will be described with reference mainly to FIG. 3. The sheet transport path is denoted by the dotted line indicated by P in FIG. 3. The printer 1 is formed so as to transport sheets in the +Y direction in FIG. 3. Note that a side in the sheet transport direction (i.e., +Y direction) in the printer 1 is referred to as "a downstream side", and a side in the opposite direction (i.e., −Y direction) is referred to as "an upstream side".

The apparatus body 2 includes a carriage 11 therein. The carriage 11 has the recording head 10 (i.e., the recording device) that performs recording by ejecting ink onto a sheet of paper that is transported. The carriage 11 is provided so as to move in a reciprocating manner in a direction (i.e., in the X-axis direction) intersecting the sheet transport direction (i.e., +Y direction). The carriage 11 is supported by a main frame 13 that extends in the X-axis direction, which is the moving direction of the carriage 11. A nozzle row is provided on the bottom surface of the recording head 10. The nozzle row is formed of a plurality of nozzles (not shown) that eject ink onto a sheet of paper that is transported below the recording head 10. Ink is supplied to the nozzles from liquid containers 12 that are mounted in the carriage 11.

The carriage 11 is formed so as to be movable by a drive force received from a carriage-driving motor 21 (FIG. 4) that serves as a "first drive source". The carriage 11 can be moved by using, for example, a known belt-drive mechanism in which the carriage 11 is fixed to an endless belt (not shown) that is operably supported by a driven pulley (not shown) and a driving pulley (not shown) attached to a drive shaft **21*a* (FIG. 4) of the carriage-driving motor 21. The carriage 11** is moved by conveying the endless belt.

The carriage-driving motor 21 (FIG. 4) is provided in the main frame 13 at one end of a region over which the carriage 11 moves (at the end in the −X direction in FIG. 4). Note that the printer 1 has a total of three drive sources including a transport motor 22 that serves as a "second drive source" and a sheet-feed motor 23 that serves as a "third drive source", which will be described below, as well as the carriage-driving motor 21 that serves as the "first drive source". Also note that in the following description, the carriage-driving motor 21, the transport motor 22, and the sheet-feed motor 23 may be generically referred to as "three drive sources".

Sheets of paper are set at the sheet-setting opening 7 and fed downstream toward the recording head 10 by means of a sheet-feed roller 14 that serves as a "feed device". The sheet-feed roller 14 is driven by a driving force received from the sheet-feed motor 23 (FIG. 4) that serves as the "third drive source".

Note that a wheel train (not shown) is connected to the sheet-feed motor 23. The wheel train is formed so as to transmit the driving force of the sheet-feed motor 23 to the sheet-feed roller 14 via the wheel train. The sheet-feed motor 23 may also function as a drive source for other components in the printer 1. For example, the sheet-feed motor 23 can be used as a drive source for a suction pump, etc., in a head maintenance unit (not shown) that performs head cleaning by sucking the recording head 10.

A sheet of paper fed by the sheet-feed roller 14 is transported to a recording region located below the recording head 10 while the sheet is nipped by a transport roller pair 15 including a transport driving-roller 15*a* and a transport driven-roller 15*b*. The transport driving-roller 15*a* is driven by a driving force received from the transport motor 22 (FIG. 4) that serves as the "second drive source". A support member 16 is provided on a side opposing the recording head 10 (a side below the recording head 10 in FIG. 3). The support member 16 regulates a sheet gap that is defined as being between a sheet of paper and the bottom surface, that is, a liquid discharge surface, of the recording head 10. Recording is performed by ejecting ink from the recording head 10 onto the sheet of paper that is located at a position between the recording head 10 and the support member 16.

A discharge roller pair 17 that includes discharge driving-roller 17*a* and discharge driven-roller 17*b* is provided downstream of the recording head 10. The discharge driving-roller 17*a* is driven by a driving force received from the transport motor 22 (FIG. 4). Note that a wheel train (not shown) is connected to the transport motor 22. The wheel train is formed so as to transmit the driving force of the transport motor 22 to the transport driving-roller 15*a* and the discharge driving-roller 17*a* via the wheel train. After recording is completed on the sheet that has been transported over the support member 16, the sheet is further transported downstream by the discharge roller pair 17, discharged from a discharge unit 18, and stacked on the sheet-discharge cover 5 that opens. The sheet transport path of the printer 1 has been outlined so far.

Internal Structure of Apparatus Body

Positional Relationships of Three Drive Sources and Battery

Next, the internal structure of the apparatus body will be described. As illustrated in FIG. 4, the printer 1 includes three drive sources, in other words, the carriage-driving motor 21, the transport motor 22, and the sheet-feed motor 23, inside the apparatus body 2. Note that in FIG. 4, components other than the three drive sources and a battery 20 are omitted in order to highlight the positional relationships of the three drive sources and the battery 20.

The battery 20 (FIG. 4) that supplies electric power to each of the three drive sources is also provided inside the apparatus body 2. The battery 20 is accommodated in a battery accommodation portion 24 that is also provided inside the apparatus body 2.

As illustrated in FIG. 4, two of the three drive sources inside the apparatus body 2, in other words, the carriage-driving motor 21 and the transport motor 22, are disposed on one side of a center portion C (i.e., a side in the −X direction) in the width direction (i.e., the X-axis direction) that intersects the medium transport direction (i.e., the +Y direction). On the other hand, the other drive source, that is, the sheet-feed motor 23 is disposed on the other side of the center portion C (i.e., a side in the +X direction) in the width direction. The battery 20 is disposed such that the center of gravity G of the battery 20 is closer to the sheet-feed motor 23 with respect to the center portion C in the width direction. Note that as illustrated in FIG. 11, the battery 20 according to the example has an external shape similar to a rectangular solid extending in the X-axis direction, having the center of gravity G substantially at the center thereof in the X-, Y-, and Z-axes directions. In FIG. 11, reference numeral 20*a* indicates a handle to be used when the battery 20 is inserted into or removed from the battery accommodation portion 24.

Drive sources such as motors are heavy items. When two of the three drive sources (i.e., the carriage-driving motor 21 and the transport motor 22) are disposed on one side with respect to the center portion C (i.e., the side in the −X direction) in the X-axis direction (i.e., the width direction), while the other drive source (i.e., the sheet-feed motor 23) is disposed on the other side with respect to the center portion C (i.e., the side in the +X direction), the weight distribution in the X-axis direction of the whole printer 1 tends to be shifted in the −X direction. However, as illustrated in FIG. 4, the battery 20 is disposed such that the center of gravity G of the battery 20 is positioned closer toward the sheet-feed motor 23 with respect to the center portion C. This can mitigate unstable weight distribution due to the arrangement of the three drive sources and can balance the weight distribution of the whole printer 1 in the X-axis direction. Thus, the printer 1 can be stably carried and placed.

Positional Relationships of Battery and Other Components

The printer 1 has a waste liquid box 30 (see FIGS. 5 to 8) disposed on the bottom of the apparatus body 2 for receiving waste liquid (waste ink) discharged from the recording head 10. As illustrated in FIG. 8, at least a portion of the battery accommodation portion 24 and at least a portion of the waste liquid box 30 overlap each other in the Z-axis direction, that is, the height direction of the apparatus. Note that in FIG. 5, components other than the three drive sources and the waste liquid box 30 are omitted in order to highlight the positional relationships of the three drive sources and the waste liquid box 30. Thus, the height of the printer 1 can be reduced by overlapping at least a portion of the battery accommodation portion 24 and at least a portion of the waste liquid box 30 in the height direction of the apparatus.

In addition, in the example, the battery accommodation portion 24 (a portion accommodating the battery 20 in FIG. 3) is disposed such that at least a portion of the battery accommodation portion 24 is located below the sheet-feed roller 14. Disposing the battery accommodation portion 24 in such a manner and accommodating therein the battery 20, which is another heavy item, can lower the center of gravity of the whole printer 1 while efficiently utilizing the space inside the apparatus body 2.

Moreover, in the example, the bottom portion of the apparatus body 2 is occupied by the battery accommodation portion 24 and the waste liquid box 30, as illustrated in FIG. 7. Note that the battery accommodation portion 24 and the waste liquid box 30 do not necessarily occupy the entire bottom portion of the apparatus body 2 but occupy most of the bottom portion in the example. Thus, most of the bottom portion of the apparatus body 2 is occupied by the battery accommodation portion 24 that accommodates the relatively heavy battery 20 and also occupied by the waste liquid box 30 that becomes heavier as waste liquid accumulates. This contributes to a further increase in the stability of the printer 1 when placed.

Locking Mechanism for Battery

The battery 20 in the example is replaceable and is formed capable of being inserted into and removed from the battery accommodation portion 24 that is disposed in the apparatus body 2 of the printer 1. A battery insertion/removal opening 24*a* (FIG. 9) through which the battery 20 is inserted into and removed from the battery accommodation portion 24 is provided on the side of the printer 1 in the +X direction. A cover member 36 (FIG. 9) that opens and closes the battery accommodation portion 24 is provided at the battery insertion/removal opening 24*a*. Note that in the example, the cover member 36 that opens and closes the battery accommodation portion 24 is formed so as to slide in the Y-axis direction to open and close the battery insertion/removal opening 24*a*. In FIG. 9, reference numeral 36*a* denotes a knob to be held between fingers for opening/closing the cover member 36. The cover member 36 is not limited to this configuration. For example, the cover member 36 can be formed so as to be rotatably attached to the battery insertion/removal opening 24*a* to open and close the battery insertion/removal opening 24*a* by turning the cover member 36. The cover member 36 can also be formed so as to open and close the battery insertion/removal opening 24*a* by detaching the cover member 36 from, and attaching the cover member 36 to, the battery insertion/removal opening 24*a*. Providing the cover member 36 reduces or eliminates the likelihood of foreign matter, such as dust, from entering the apparatus body 2 through the battery insertion/removal opening 24*a*.

The battery 20 includes a second contact point 26 (FIGS. 4 and 13) that is brought into electrical contact with a first contact point 25 (FIGS. 4 and 13) provided inside the apparatus body 2. Electric power is supplied from the battery 20 to various components of the printer 1 by connecting the second contact point 26 to the first contact point 25. In the example, as illustrated in FIG. 13, a connector pin (hereinafter referred to simply as a "pin") serves as the first contact point 25 and a recess for receiving the pin serves as the second contact point 26. The depth of the recess of the second contact point 26 corresponds to the contact length 54 (the length of the pin) of the first contact point 25 in the insertion direction of the battery 20. When the tip of the first contact point 25 is inserted into the second contact point 26, the first contact point 25 and the second contact point 26 are electrically connected. The electrical connection is maintained even if the first contact point 25 is not necessarily inserted to the maximum depth of the second contact point 26. Note that the first contact point 25 and the second contact point 26 may be shaped oppositely.

The printer 1 has a locking mechanism 50 that fastens the battery 20 to the apparatus body 2 while the first contact point 25 and the second contact point 26 are connected to each other. The locking mechanism 50 is provided in the apparatus body 2 and includes a lock pin 51. The lock pin 51 assumes an advancing state (FIG. 13, and the top and bottom views in FIG. 14) in which the lock pin 51 advances in a direction intersecting the insertion direction of the battery 20. The lock pin 51 also assumes a retracting state (the middle view in FIG. 14) in which the lock pin 51 is further away from the battery 20 than in the advancing state. The lock pin 51 can be formed of a resin material, such as a plastic.

The lock pin 51 is urged toward the advancing state by a coil spring 52 (FIG. 13) that serves as an urging device. The top end 52*a* of the coil spring 52 is fixed to a fixation plate 58 (see FIG. 7 and FIG. 13) provided inside the apparatus body 2, and the bottom end 52*b* of the coil spring 52 is in contact with the lock pin 51. Note that as illustrated in FIG. 8, the coil spring 52 is provided such that the coil spring 52 and at least a portion of the waste liquid box 30 overlap each other in the height direction of the apparatus (i.e., in the Z-axis direction).

The lock pin 51 assumes the advancing state when the battery 20 is not inserted into the battery accommodation portion 24 or when an end portion 20*b* of the battery 20 is located upstream of the lock pin 51 (a side in the +X direction) in the insertion direction of the battery 20 (as in the top view in FIG. 14). When the battery 20 is further inserted from the state illustrated in the top view in FIG. 14, the lock pin 51 is pushed upward against the urging force of the coil spring 52 as the end portion 20*b* of the battery 20 advances in the −X direction. Note that in each view in FIG. 14, the dotted line indicated by reference letter S denotes the position of the tip 51*a* of the lock pin 51 that is in the advancing state.

When the second contact point 26 of the battery 20 is inserted until it is connected to the first contact point 25 of the apparatus body 2 as illustrated in the bottom view in FIG. 14, the lock pin 51 in the advancing state engages a recess-shaped engagement portion 53 provided in the battery 20. Consequently, the movement of the battery 20 in the X-axis direction is restrained, and the locking mechanism 50 enters a locking state (also see FIG. 13).

When the lock pin 51 in the retracting state, which is illustrated in the middle view in FIG. 14, comes into engagement with the recess-shaped engagement portion 53 as illustrated in the bottom view, the coil spring 52 urges the lock pin 51 to enter the advancing state. At this moment, the urging force of the coil spring 52 generates an impact, which is transferred (as a clicking feeling) to a user who is inserting the battery 20 by hand or which produces a sound. Thereby, the user easily recognizes that the locking mechanism 50 has entered the locking state. In addition, when the lock pin 51 enters the retracting state in which the lock pin 51 is retracted upward, the lock pin 51 is released from the engagement with the engagement portion 53, and the locking mechanism 50 enters an unlocked state.

Here, the urging force of the coil spring 52 is set such that the battery 20 is not dislodged due to weight when the apparatus body 2 is inclined such that the direction in which the battery 20 may be dislodged (i.e., the +X direction) is aligned with the gravity direction. This reduces the likelihood of the locking mechanism 50 being released from the locking state and the battery 20 being dislodged when the apparatus body 2 is inclined such that the direction in which the battery 20 may be dislodged is aligned with the gravity direction, in other words, when the printer 1 is inclined until the side in the +X direction faces downward.

In addition, it is desirable that the lock pin 51 have an inclined surface at the tip 51*a* that opposes the engagement portion 53 as illustrated in FIG. 13. The inclined surface faces at least downstream of the tip 51*a* in the insertion direction of the battery 20 (i.e., the −X direction). In the example, the lock pin 51 has a first inclined surface 56 that faces downstream of the tip 51*a* in the insertion direction (i.e., the −X direction) and a second inclined surface 57 that faces upstream of the tip 51*a* in the insertion direction (i.e., the +X direction). The first inclined surface 56 and the second inclined surface 57 are both flat surfaces, and the tip 51*a* of the lock pin 51 corresponds to a portion at which the first inclined surface 56 and the second inclined surface 57 intersects.

In the locking state (FIG. 13) of the locking mechanism 50, the lock pin 51 is urged toward the advancing state, that is, in the −Z direction. Urging the lock pin 51 in the −Z direction causes the first inclined surface 56 to push an edge portion 53*a* (i.e., the edge in the −X direction) of the engagement portion 53 in the −X direction. The battery 20 is thereby pushed in the −X direction, that is, in the insertion direction of the battery 20. Thus, the locking mechanism 50 reliably enters the locking state.

On the other hand, the second inclined surface 57 is brought into contact with the end portion 20*b* of the battery 20 when the battery 20 is inserted (the top view in FIG. 14). When the battery 20 is further inserted from the state illustrated in the top view in FIG. 14, the end portion 20*b* advances so as to follow the second inclined surface 57 and comes under the lock pin 51. Consequently, the lock pin 51 is pushed to enter the retracting state (the middle view in FIG. 14). Thus, providing the tip 51*a* of the lock pin 51 with the second inclined surface 57 that guides the end portion 20*b* when the battery 20 is inserted enables the lock pin 51 to smoothly enter the retracting state. Note that in the example, the tip 51*a* of the lock pin 51 is formed into a tapered shape in which two flat surfaces, in other words, the first inclined surface 56 and the second inclined surface 57, abut each other. However, the tip 51*a* may also be formed into a tapered conical shape.

In addition, the contact length 54 (FIGS. 12 and 13) of the first contact point 25 in the insertion direction of the battery 20 is set to be larger than a distance 55 (FIG. 12) between the cover member 36 in a closed state and the trailing end of the battery 20 in the insertion direction when the locking mechanism 50 is in the locking state. When the relation between the contact length 54 of the first contact point 25 and the distance 55 between the cover member 36 and the trailing end of the battery 20 in the insertion direction is set as such, the displacement of the battery 20 in the +X direction is suppressed to no more than the contact length 54 of the first contact point 25 because the trailing end of the battery 20 in the insertion direction abuts the cover member 36 even if, for example, the printer 1 is inclined in a direction in which the battery 20 comes out and the battery 20 moves in a battery-removal direction (i.e., the +X direction). Thus, the first contact point 25 does not completely come out from the second contact point 26, which can maintain the electrical connection. Thus, in the state in which the cover member 36 is closed, the connection between the first contact point 25 and the second contact point 26 can be made more reliable. Note that even in the state in which the trailing end of the battery 20 in the insertion direction abuts the cover member 36, the lock pin 51 of the locking mechanism 50 is formed so as to continue to engage the engagement portion 53 of the battery 20, and thus the locking state is maintained.

Battery Accommodation Portion

Inside the apparatus body 2, the battery accommodation portion 24 is formed so as to have partition walls for separating the inside of the battery accommodation portion 24, in other words, for separating the space for accommodating the battery 20, from the space for containing mechanisms for recording (including the recording head 10, the carriage-driving motor 21, the transport motor 22, and the sheet-feed motor 23).

More specifically, the apparatus body 2 is formed of two members, in other words, an upper housing 31 and a lower housing 32, and the battery accommodation portion 24 is provided in the lower housing 32, as illustrated in FIG. 7. The lower housing 32 includes a first side wall 61, a second side wall 62, and a rear side wall 63, which enclose the space for accommodating the battery 20 and define the battery accommodation portion 24 (see FIG. 7 and also FIG. 8). In addition, a top side portion 64 (FIGS. 8 and 12) is provided in the upper housing 31. The top side portion 64 includes a first upper side wall 65 and a second upper side wall 66. The first upper side wall 65 and the second upper side wall 66 partially overlap the first side wall 61 and the second side wall 62 of the lower housing 32, respectively, in such a manner that the overlapped portions extend in the height direction of the apparatus (FIG. 8).

The battery accommodation portion 24 is separated from the mechanisms for recording by the first side wall 61, the second side wall 62, and the rear side wall 63 that are provided in the lower housing 32, and the top side portion 64, the first upper side wall 65, and the second upper side wall 66 that are provided in the upper housing 31. This can reduce the likelihood that, for example, ink mist generated by ejecting ink from the recording head 10 adheres to the second contact point 26 of the battery 20 or to the apparatus.

As illustrated in FIG. 8 and FIG. 10, the battery 20 is formed into an asymmetrical cross-sectional shape in a cross section (i.e., a cross-sectional shape on the Y-Z plane) taken in a direction intersecting the insertion direction (i.e., the X-axis direction). In the example, the cross-sectional shape is formed into a rectangle with one corner being truncated (the lower right corner in FIGS. 8 and 10). In addition, the battery insertion/removal opening 24*a* (FIG. 9) at the battery accommodation portion 24 is formed so as to fit the asymmetrical cross-sectional shape of the battery 20.

By forming the battery 20 into the asymmetrical cross-sectional shape, and by forming the battery insertion/removal opening 24*a* at the battery accommodation portion 24 so as to fit the asymmetrical cross-sectional shape of the battery 20, the insertion direction of the battery 20 is restricted to one direction. Thus, a user can easily recognize the insertion direction of the battery 20. The user also can avoid inserting the battery 20 in a wrong direction.

As illustrated in FIGS. 8 and 10, the battery accommodation portion 24 includes support ribs 27 for supporting the battery 20 and restraining ribs 28 for restraining the battery 20 from moving upward. A pair of the support ribs 27 are provided on the bottom of the lower housing 32, and a pair of the restraining ribs 28 are provided in the top side portion 64 of the upper housing 31. Providing the battery accommodation portion 24 with the support ribs 27 and the restraining ribs 28 reduces the contact area of the battery 20 in the battery accommodation portion 24 and enables the battery 20 to be smoothly inserted into or removed from the battery accommodation portion 24.

Other Structures of Printer

Handle

In the embodiment, the handle 6 (see FIG. 9), which is a portion to be held by a user when carrying the printer 1, has a grip 40 extending in the width direction of the apparatus and handle extensions 41*a* and 41*b* (FIG. 4) provided at both ends of the grip 40. The handle 6 is formed capable of turning toward the front side from a position in which the grip 40 is behind the apparatus as in FIG. 1 (not completely shown in FIG. 1). When a user holds the handle 6, the handle 6 assumes the state in which the grip 40 is positioned almost directly above the top surface (the surface in the +Z direction) of the printer 1, as illustrated in FIG. 9. Note that when the printer 1 is operated, the handle 6 is normally placed in the state illustrated in FIG. 2.

The attachment locations 67 (FIG. 10) at which the handle 6 is attached to the side surfaces of the apparatus body 2 in the X-axis direction are each located at a position between the battery 20 and the waste liquid box 30 in the Y-axis direction, that is, in the depth direction of the apparatus. Disposing each attachment location 67 of the handle 6 at a position between the battery 20 and the waste liquid box 30 in the Y-axis direction increases the stability when the apparatus body 2 is lifted by holding the handle 6 because the weight distribution in the Y-axis direction becomes balanced.

Circuit Board Provided Inside Apparatus Body

The printer 1 includes a first circuit board 34 and a second circuit board 35 that serve as control units for controlling various components including the carriage-driving motor 21, the transport motor 22, and the sheet-feed motor 23. As illustrate in FIG. 6, the first circuit board 34 is provided in the top portion of the apparatus body 2, and the second circuit board 35 is provided in a rear side in the apparatus body 2. The components, such as the carriage-driving motor 21, the transport motor 22, the sheet-feed motor 23, and the recording head 10, that can be controlled by the control units are connected to any of the first circuit board 34 and the second circuit board 35 via cables (such as flexible flat cables).

The entire disclosure of Japanese Patent Application No. 2016-192986, filed Sep. 30, 2016 is expressly incorporated by reference herein.

What is claimed is:

1. A recording apparatus comprising:

an apparatus body including a recording device therein, the recording device performing recording onto a medium to be transported;

at least three drive sources provided inside the apparatus body;

a battery provided inside the apparatus body and supplying electric power to the three drive sources;

a locking mechanism disposed inside the apparatus body; and a battery accommodation portion provided inside the apparatus body and accommodating the battery, wherein, of the three drive sources, a first drive source and a second drive source are disposed on one side of the apparatus body with respect to a center portion of the apparatus body in a width direction that intersects a medium transport direction, and a third drive source is disposed on the other side of the apparatus body with respect to the center portion in the width direction, the battery has a center of gravity that is on the other side with respect to the center portion in the width direction, the battery includes a second contact point that is electrically coupled to a first contact point provided inside the apparatus body and that is formed such that the battery can be inserted into and removed from the battery accommodation portion, the locking mechanism fastens the battery to the apparatus body with the first contact point and the second contact point being connected to each other, the locking mechanism includes a lock pin that assumes an advancing state in which the lock pin advances in a direction intersecting an insertion direction of the battery or a retracting state in which the lock pin is further away from the battery than in the advancing state and the locking mechanism also includes an urging device that urges the lock pin toward the advancing state, the locking mechanism is formed such that the lock pin enters a locking state by engaging with an engagement portion provided in the battery when the lock pin is in the advancing state and enters an unlocking state when the lock pin is in the retracting state, and an urging force of the urging device is such that the battery is not dislodged due to weight when the apparatus body is inclined such that a direction in which the battery may be dislodged is aligned with a gravity direction.

2. The recording apparatus according to claim 1, further comprising a carriage that holds the recording device and moves in a direction intersecting the medium transport direction, wherein any of the first drive source and the second drive source is a drive source for the carriage.

3. The recording apparatus according to claim 1, wherein the lock pin includes an inclined surface that is provided at a tip of the lock pin opposing the engagement portion and that faces at least downstream of the tip in the insertion direction of the battery.

4. The recording apparatus according to claim 1, further comprising a cover member that opens and closes the battery accommodation portion.

5. The recording apparatus according to claim 4, wherein a contact length of the first contact point in the insertion direction of the battery is larger than a distance between the cover member in a closed state and a trailing end of the battery in the insertion direction of the battery when the locking mechanism is in the locking state.

6. The recording apparatus according to claim 1, further comprising a battery insertion/removal opening at the battery accommodation portion, wherein the battery is formed so as to have an asymmetrical cross-sectional shape along a cross section taken in a direction intersecting the insertion direction, and the battery insertion/removal opening is shaped so as to fit the asymmetrical cross-sectional shape.

7. The recording apparatus according to claim 1, wherein the battery accommodation portion includes a support rib for supporting the battery and a restraining rib for restraining the battery from moving upward.

8. The recording apparatus according to claim 1, further comprising a waste liquid box that is provided in a bottom portion of the apparatus body and that is for receiving waste liquid from the recording device, wherein at least a portion of the waste liquid box and at least a portion of the battery accommodation portion overlap each other in a height direction of the apparatus body.

9. The recording apparatus according to claim 8, wherein the bottom portion of the apparatus body is occupied by the battery accommodation portion and the waste liquid box.

10. A recording apparatus comprising:

an apparatus body including a recording device therein, the recording device performing recording onto a medium to be transported;

a feed device provided inside the apparatus body and feeding the medium toward the recording device from a position at which the medium is set;

a locking mechanism disposed inside the apparatus body;

a battery provided inside the apparatus body; and a battery accommodation portion provided inside the apparatus body and accommodating the battery, wherein, at least a portion of the battery accommodation portion is located below the feed device, the battery includes a second contact point that is electrically coupled to a first contact point provided inside the apparatus body and that is formed such that the battery can be inserted into and removed from the battery accommodation portion, the locking mechanism fastens the battery to the apparatus body with the first contact point and the second contact point being connected to each other, the locking mechanism includes a lock pin that assumes an advancing state in which the lock pin advances in a direction intersecting an insertion direction of the battery or a retracting state in which the lock pin is further away from the battery than in the advancing state and the locking mechanism also includes an urging device that urges the lock pin toward the advancing state, the locking mechanism is formed such that the lock pin enters a locking state by engaging with an engagement portion provided in the battery when the lock pin is in the advancing state and enters an unlocking state when the lock pin is in the retracting state, and an urging force of the urging device is such that the battery is not dislodged due to weight when the apparatus body is inclined such that a direction in which the battery may be dislodged is aligned with a gravity direction.

* * * * *